US008313127B2

(12) United States Patent
Helms

(10) Patent No.: US 8,313,127 B2
(45) Date of Patent: Nov. 20, 2012

(54) LATCH FOR A VEHICLE DOOR

(75) Inventor: James M. Helms, Fort Myers, FL (US)

(73) Assignee: Ibis Tek, LLC, Butler, PA (US)

( * ) Notice: Subject to any disclaimer, the term of this patent is extended or adjusted under 35 U.S.C. 154(b) by 394 days.

(21) Appl. No.: 12/655,302

(22) Filed: Dec. 28, 2009

(65) Prior Publication Data

US 2010/0171323 A1 Jul. 8, 2010

Related U.S. Application Data

(60) Provisional application No. 61/204,508, filed on Jan. 7, 2009.

(51) Int. Cl.
*E05C 19/00* (2006.01)

(52) U.S. Cl. ..... 292/259 A; 292/163; 292/DIG. 21; 292/DIG. 65

(58) Field of Classification Search ..... 292/259 A, 292/163, 166, DIG. 21, 21, 92, DIG. 65
See application file for complete search history.

(56) References Cited

U.S. PATENT DOCUMENTS 2,159,581 A * 5/1939 Anderson ..... 292/47
* cited by examiner

*Primary Examiner* — Carlos Lugo
*Assistant Examiner* — Mark Williams
(74) *Attorney, Agent, or Firm* — Karen Tang-Wai Sodini

(57) ABSTRACT

A latch for latching closed a door of a vehicle, especially designed to minimize the force required to latch closed the door by pushing the door to its closed position. A tongue, having a strike face and a catch face, is resiliently mounted in the latch so as to be urged to a latch-engaged position by a torsion spring pushing against a surface of the tongue and against a cover plate of the latch. A slider block is coupled to a door handle and to the tongue so that the tongue can be swiveled to a disengaged state by use of the door handle, in order to open the vehicle door.

1 Claim, 8 Drawing Sheets

LATCH FOR A VEHICLE DOOR

CROSS REFERENCE TO RELATED APPLICATION

Reference is made to and priority claimed from U.S. provisional application Ser. No. 61/204,508, filed on Jan. 7, 2009.

FIELD OF THE INVENTION

The present invention pertains to the field of vehicles. More particularly, the present invention pertains to latches for utility vehicles, including such vehicles used for military and security applications.

BACKGROUND OF THE INVENTION

In the war against terrorism, because of the increasing explosive force of IEDs (Improvised Explosive Devices) and other explosive devices used by terrorists, it has become desirable to provide more and more armor for military and security vehicles, to the point where the doors of some such vehicles weigh hundreds of pounds. If such a vehicle is stopped on an incline, an occupant may struggle to open the door, and in some cases may not be able to open the door at all.

In response, it has become necessary to develop motorized mechanisms for providing assistance in opening such doors.

Such doors have typically been provided with a primary door latch, including a tongue portion that is forced downward to an open position as the door is closed, and when the door closes the tongue springs back to its up position, so that the latch is then in its closed position and holds the door closed. To open the door a handle is used, which retracts the tongue, placing the latch in the open position and allowing the door to be pushed or pulled open.

Such latches for a door of a vehicle are intended to hold the door closed even in case of a violent explosion. Apparently with such a goal in mind, the latches have been designed so as to require significant force to close them, typically 40-90 pounds of spring force must be overcome in pushing the tongue of such a latch to the down position.

As the doors of such vehicles are increasingly more heavily armored and thus weigh more, the significant force required to place a latch of such a door in the open position by pushing or pulling on the open door in order to close it, imposes an additional, significant load on motorized door assist mechanisms.

What is needed is a latch that can be placed in a position allowing a door to be closed, without requiring undue force.

DISCLOSURE OF INVENTION

Accordingly, the invention provides a latch, for mounting on a vehicle door, including a tongue coupled to a slider block via control links, arranged so that the tongue swivels downward (as opposed to being pushed downward) to a depressed state, to allow the vehicle door to close, and when the door closes, the tongue springs to an upward position, holding the door closed. The door is opened via a control rod pulling downward on the slider block, which in turn pulls the tongue to its depressed state.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 3:
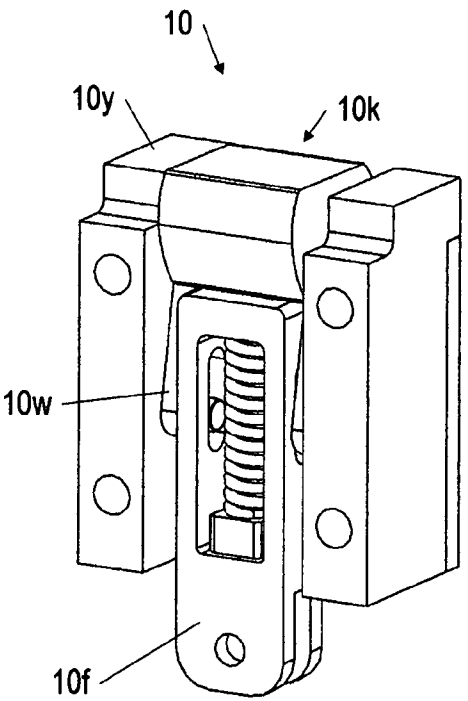
FIGS. 1-11 are perspective drawings of a latch for a vehicle door, according to the invention, in various states of operation.

The following is a list of reference labels used in the drawings to label components of different embodiments of the invention, and the names of the indicated components.

10 latch
10*a* slider spring
10*b* spring perch
10*c* spring perch member
10*d* anchor members
10*e* cover plate
10*f* slider block
10*g* aperture in the slider block
10*h* cutout portion of slider block
10*j* control link aperture or slider block aperture
10*k* tongue
10*m* strike face
10*n* catch face
10*p* apex portion
10*q* aperture
10*r* control link dowel pin
10*s* aperture
10*t* swivel dowel pin
10*u* cavity
10*v* torsion spring
10*w* elongated control link
10*x* slider dowel pin
10*y* side block
10*z* side block aperture
11*a* pin
11*b* control rod
12 fastener
14 vehicle door
14*a* window
15 door frame surface

DETAILED DESCRIPTION

The invention provides a latch for a vehicle door, and in particular a latch that closes without undue force when the vehicle door is pushed closed.

Figures 9, 10, 11:
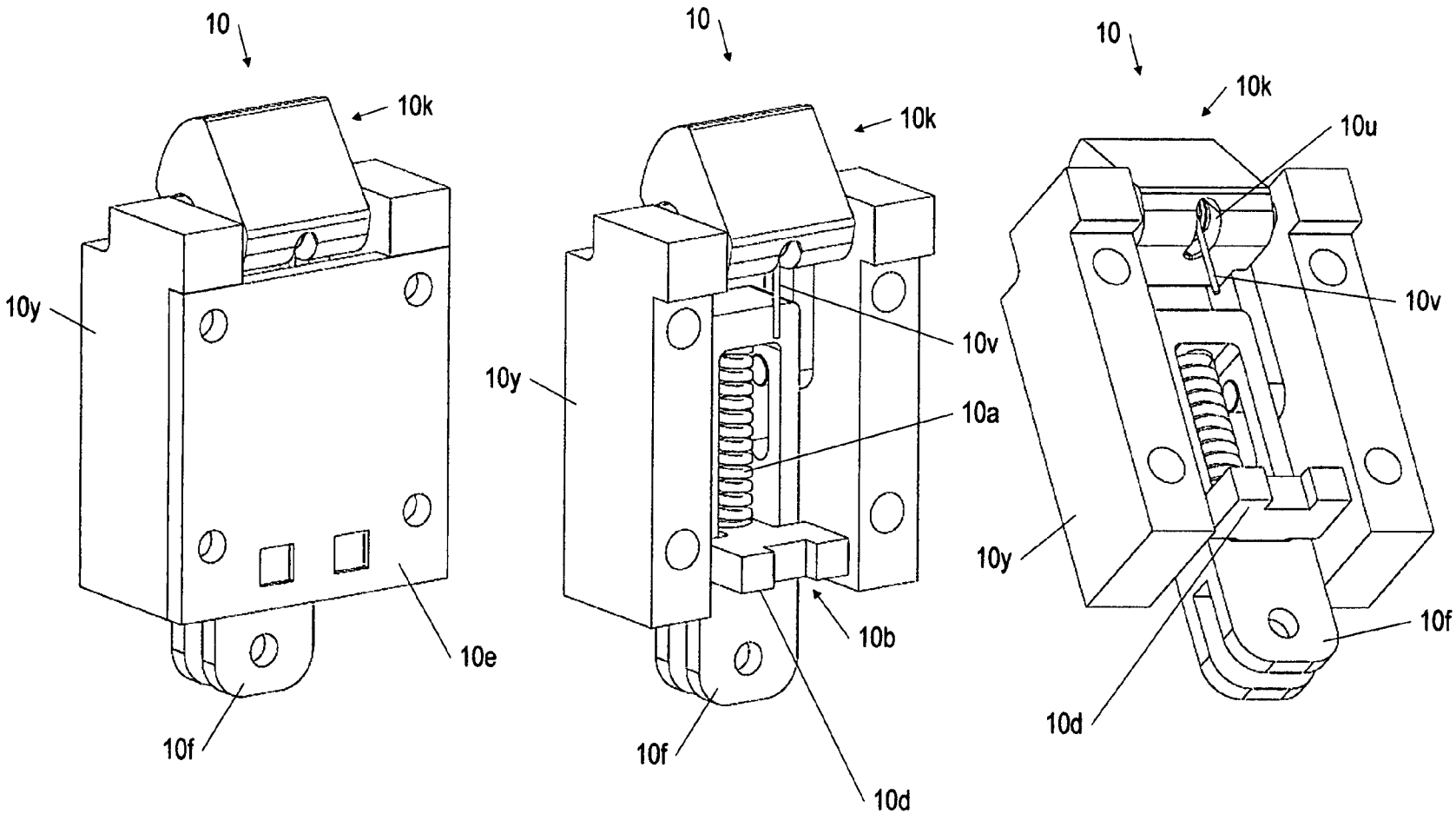
Figure 12:
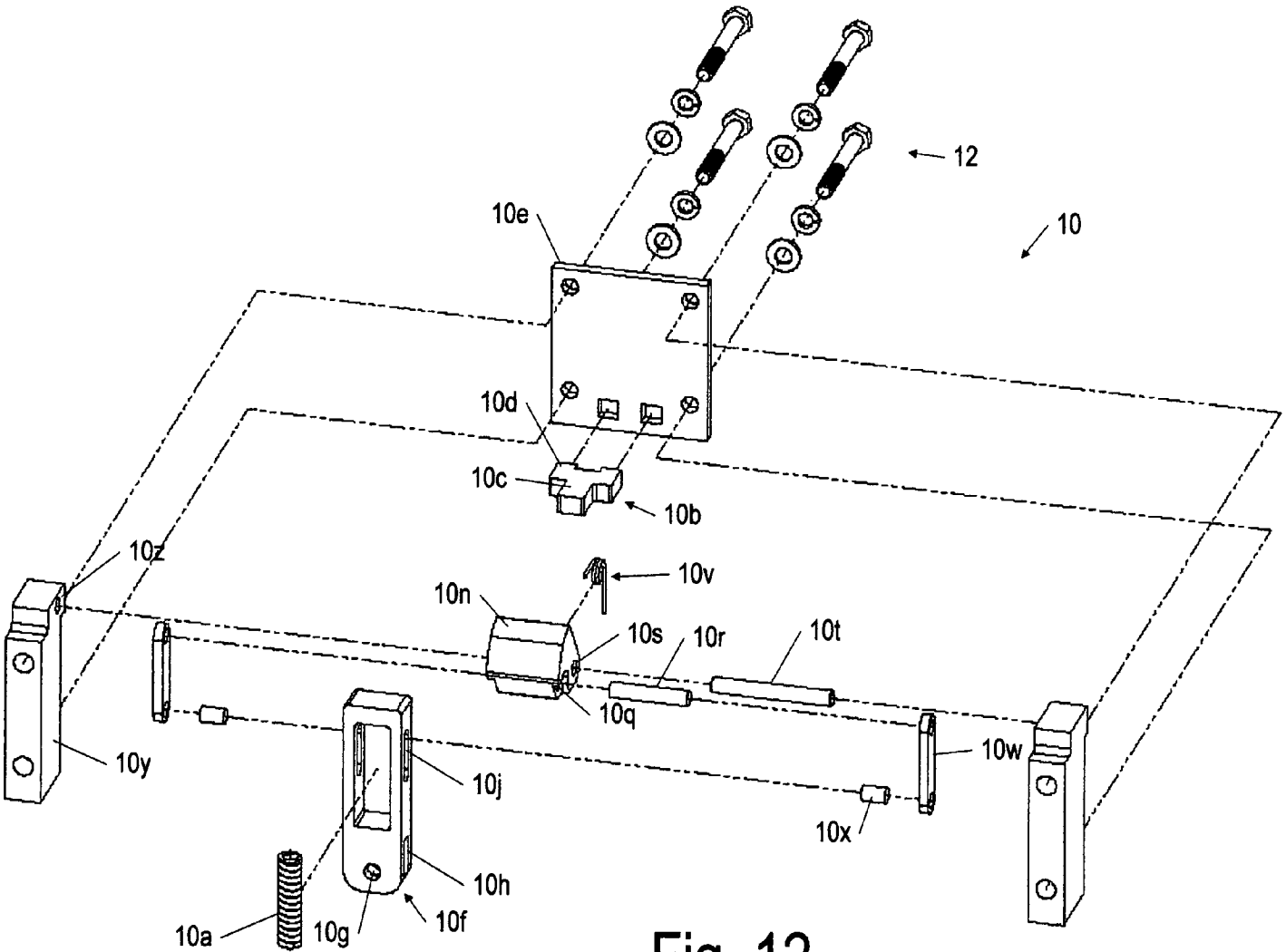
FIG. 12 is an exploded view perspective drawing of the latch of FIGS. 1-11.

Referring now to FIGS. 1-12, the invention provides a latch 10, having a slider spring 10*a* mounted on a spring perch 10*b*. The spring perch has a spring perch member 10*c* (FIG. 12) for providing a stop for the slider spring, and also has protruding anchor members 10*d* (FIG. 12).

Referring now especially to FIG. 12, the latch has a cover plate 10*e*, having apertures for receiving fasteners 12 (FIG. 12) for attaching the door latch to the door, and having apertures for receiving the anchor members 10*d* of the spring perch 10*b*.

The spring perch member 10*c* protrudes into the bottom portion of an aperture of a slider block 10*f*, which aperture contains the slider spring 10*a*. The slider block 10*f* also has an aperture 10*g* for receiving a pin 11*a* (FIG. 4) for coupling the slider block to a control rod 11*b* coupled to a door handle (not shown). The slider block has a cutout portion 10*h* for receiving the control rod and disposed so that the pin passes through the cutout portion, and has two control link apertures 10*j*, each opening into the aperture for holding the slider spring, from an opposite side of the slider block.

The latch 10 also includes a tongue 10*k*, provided as a body formed so as to have a substantially planar strike face 10*m* and a curved catch face 10*n* (see especially FIGS. 1 and 2) meeting at an apex portion 10*p* of the tongue, and having an aperture 10*q* (FIG. 12) proximate to the catch face for receiving a control link dowel pin 10*r*, and having an aperture 10*s* proximate the strike face for receiving a swivel dowel pin 10*t* (FIG. 12), and having a cavity 10*u* (FIG. 11) aligned with and encompassing a portion of the aperture proximate the strike face. Within the cavity 10*u* is mounted a torsion spring 10*v* having two arms, disposed within the cavity, and having a coiled portion forming an annular body pierced by the swivel pin 10*t* and oriented so as to urge a pivoting of the tongue about the swivel dowel pin in a direction away from the slider block, by one arm pushing against the cover plate 10*e* and the other arm pushing against a surface of the tongue 10*k*.

The latch 10 also includes two elongated control links 10*w* each having an aperture at an uppermost end and also at a lowermost end, and two slider dowel pins 10*x*. The two control links are disposed on opposite sides of the slider block 10*f*, and each is coupled to the slider block via a respective one of the slider dowel pins 10*x* extending from a respective one of the lowermost apertures into the proximate slider block aperture 10*j*. Each control link is also coupled to the tongue via the control link dowel pin 10*r* extending out from both sides of the tongue into the uppermost apertures of the control links.

Figure 4:
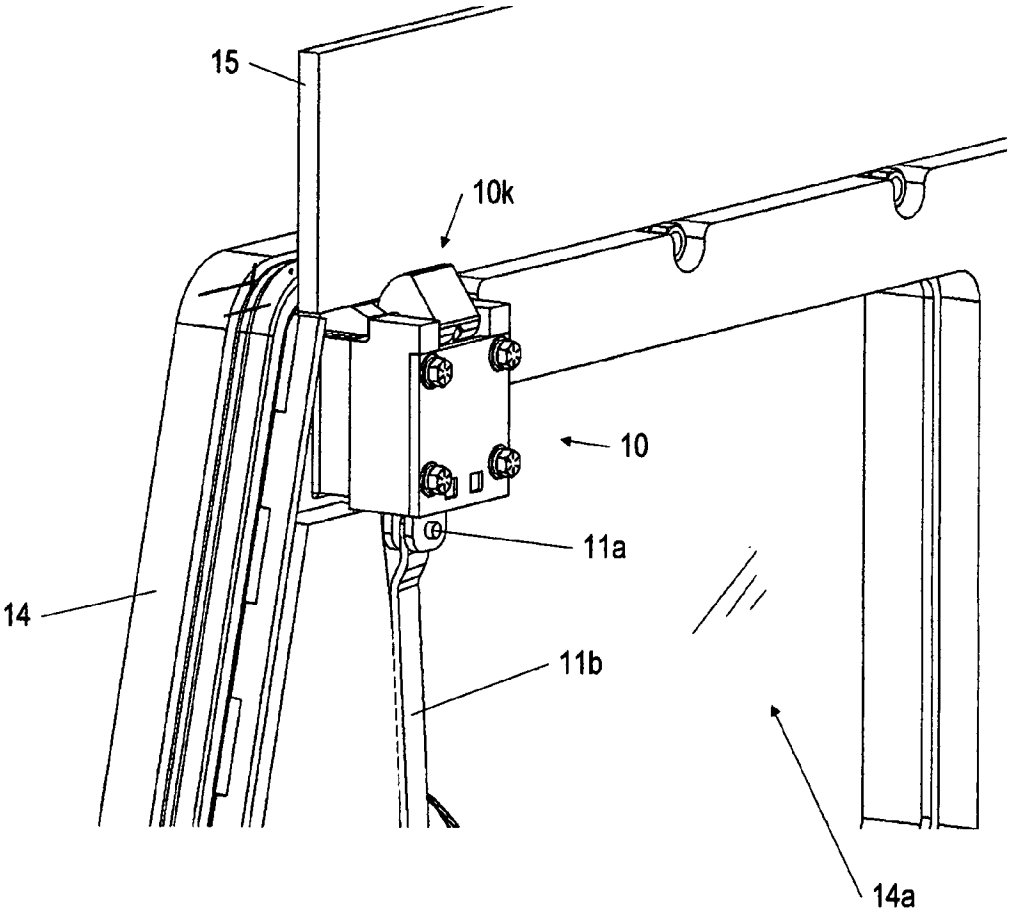

Finally, the latch 10 also includes two side blocks 10*y*, each having apertures 10*z* for receiving a respective one or more of the fasteners 12 (FIG. 12) for attaching the door latch to the vehicle door (as shown in e.g. FIG. 4). The side blocks 10*y* are disposed on opposite sides of the slider block 10*f*, and each has an aperture 10*z* for receiving the swivel dowel pin 10*t* on which the tongue swivels relative to the two side blocks.

Figure 5:
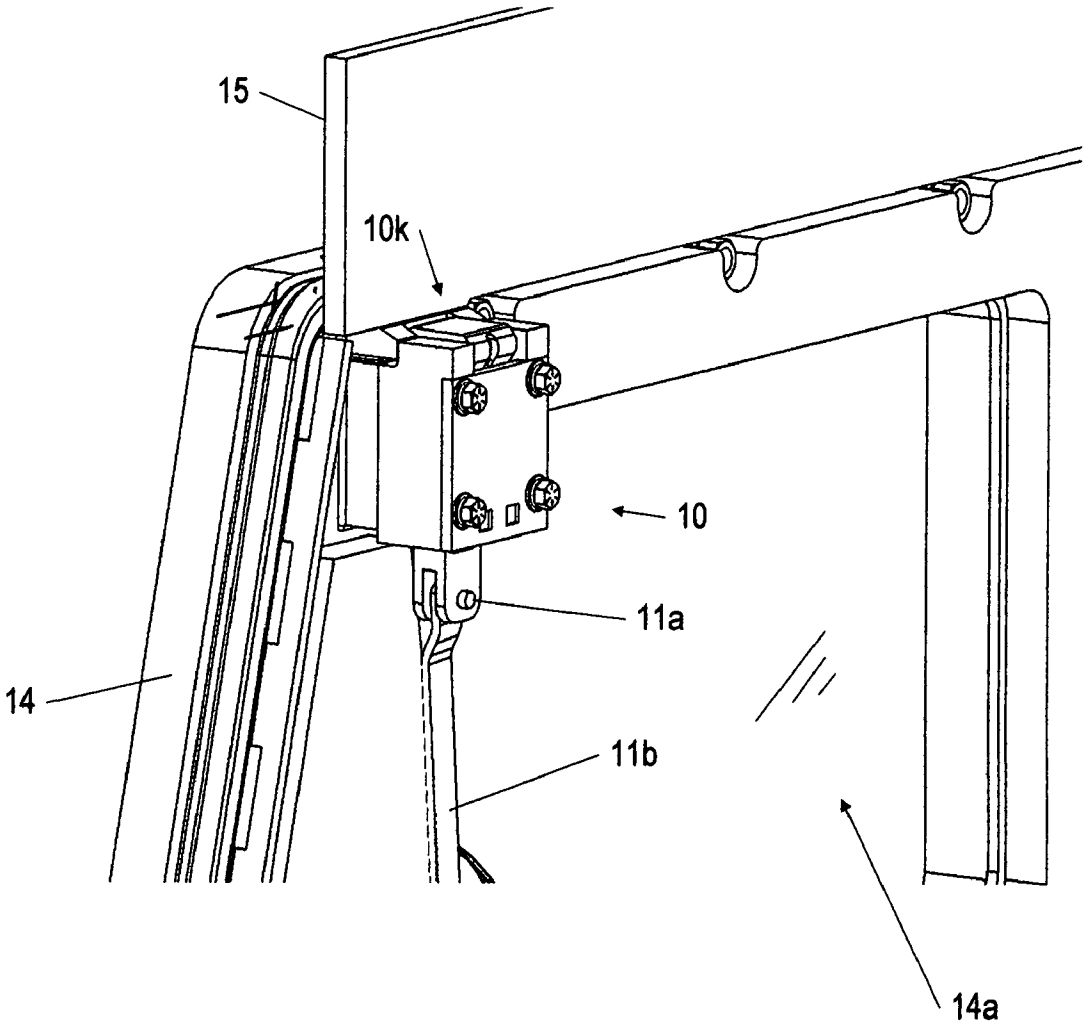
Figure 6:
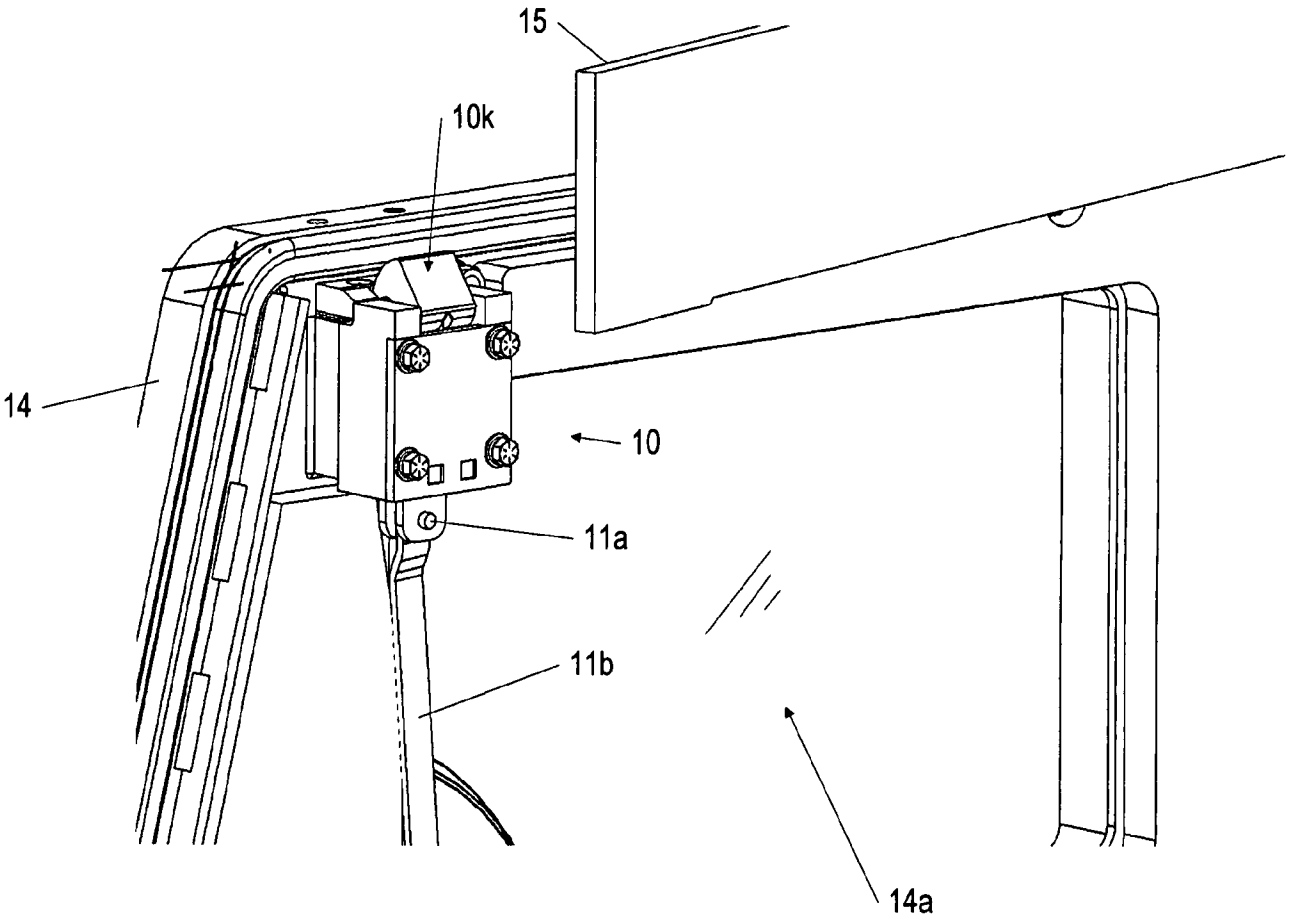
Figure 7:
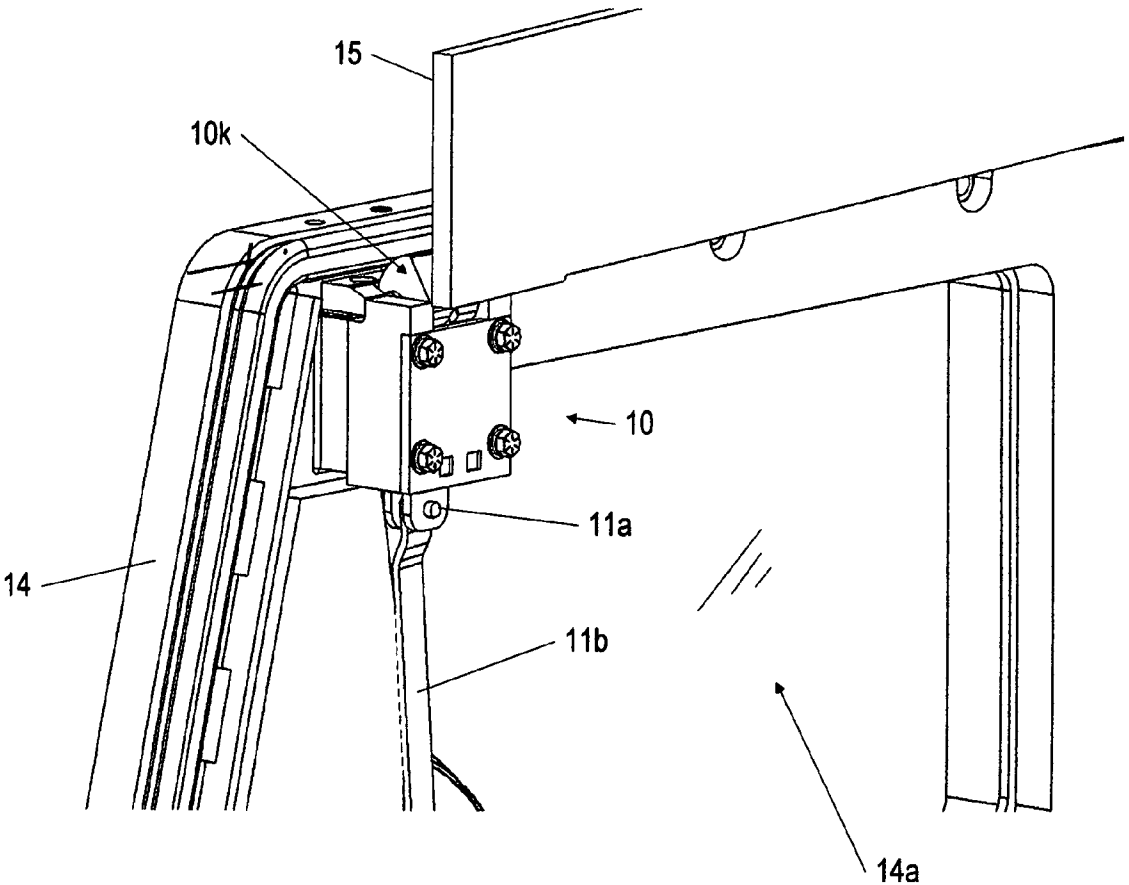
Figure 8:
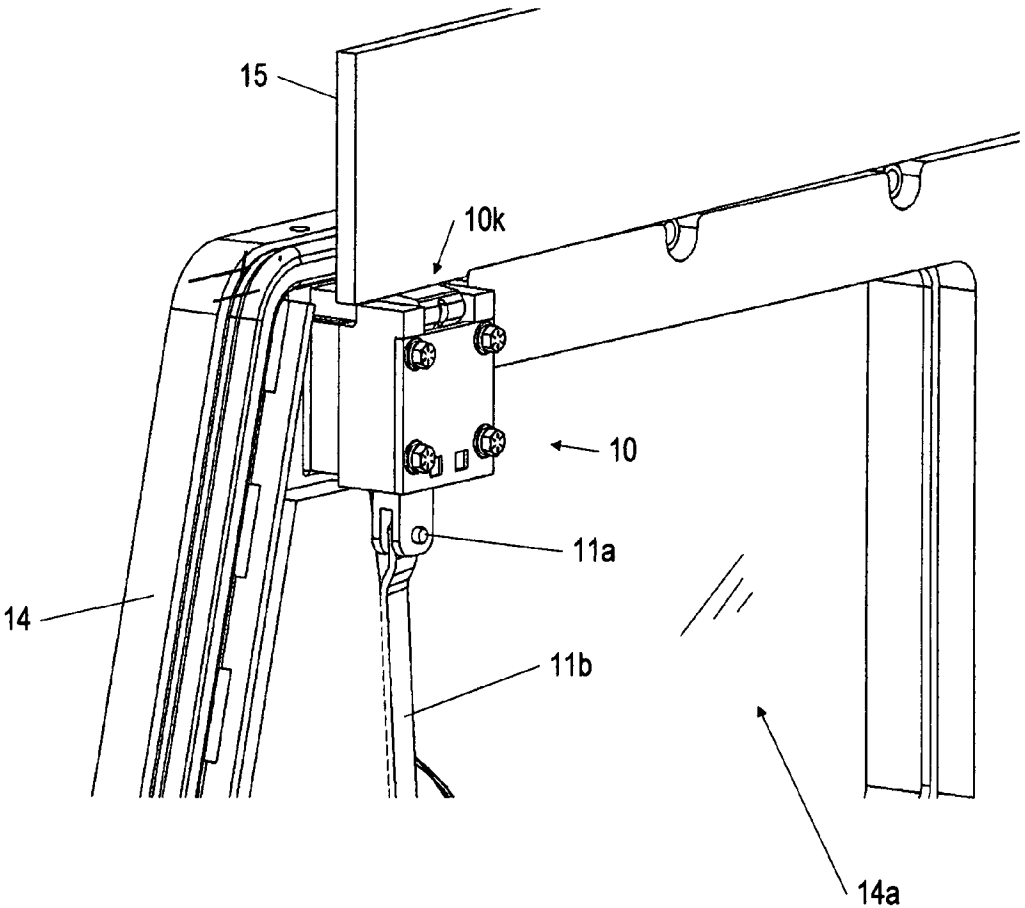

Operation of the latch 10 is most easily understood by reference to FIGS. 4-8, which shows the latch mounted on a vehicle door 14 having a window 14*a*. The door is made to close on a vehicle body having a door frame surface 15 (FIG. 4). In FIG. 4, the door is closed. In FIG. 5, the door is being opened (by an occupant of the vehicle using a handle to pull down on the control rod 11*b*). In FIG. 6, the door is swinging open. In FIG. 7, the door is swinging closed, and the tongue 10*k* is about to strike the door frame surface 15. In FIG. 8, the closing of the door has caused the tongue to depress, and the door is continuing to its final closed position, shown in FIG. 4.

Thus, in FIG. 4, the door is closed. In the closed position, the tongue 10*k* is held in its up position by the combined urging of the slider spring 10*a* and torsion spring 10*v* (FIG. 10). The state of the latch (i.e. whether the tongue is up or down, etc.) in FIG. 4 is the same as the state of the latch in FIGS. 1 and 9-11.

Figure 2:
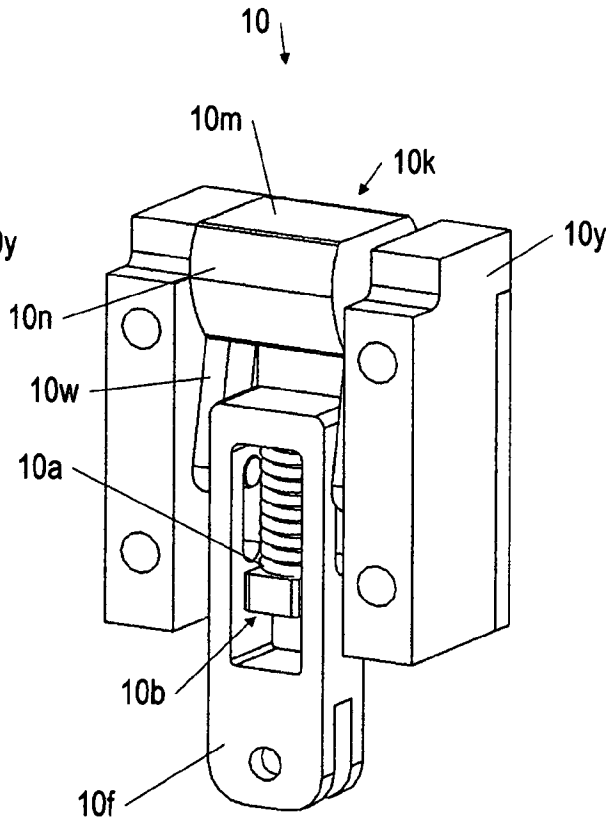
Figure 1:
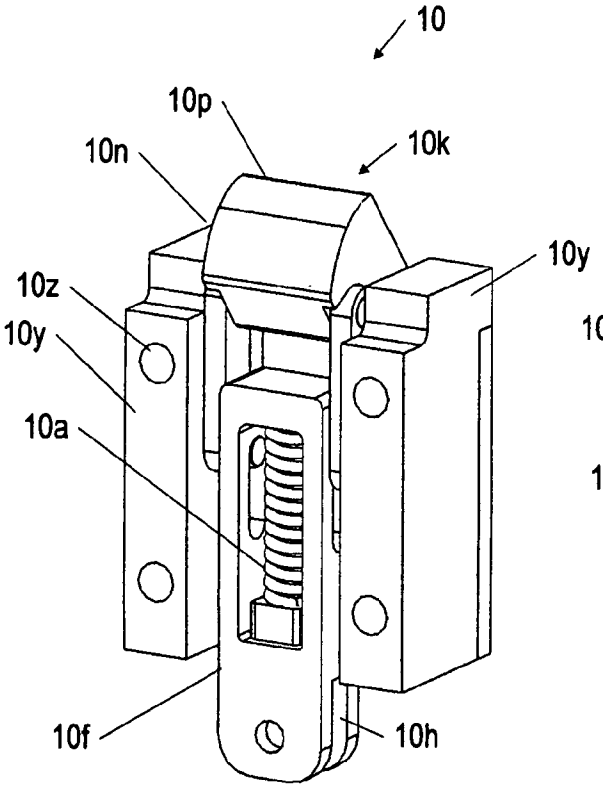

FIGS. 2 and 5 show the latch when the door handle (not shown) is used to pull down on the control rod 11*b*, to release the latch, and so allow the door to open (which is shown in FIG. 6). The spring perch 10*b* (FIG. 10) remains (at all times) in a fixed position relative to the door, but as the door handle (under a force exerted by a vehicle occupant) pulls down on the control rod 11*b*, the control rod in turn pulls the slider block 10*f* downward, and the slider block in turn pulls the tongue 10*k* downward to a depressed orientation, via the control links 10*w*. In this action, the tongue swivels on the swivel dowel pin 10*t* extending into the two side blocks 10*y* (FIG. 12).

FIGS. 3 and 8 show the latch while the door is closing, but not yet closed all the way, at the point where the tongue 10*k* is located directly beneath the door frame 15. The closing of the door causes the tongue to strike the door frame, with the result that the tongue swivels to a down position, on the swivel dowel pin 10*t*, so that the strike face of the tongue faces the bottom of the door frame (i.e. faces upward). Note that the slider block 10*f* does not move while the tongue 10*k* is being depressed as the door is closing. FIG. 4 shows the door in the final, closed position.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A door latch for a door of a vehicle, the door latch comprising:

a slider spring (10*a*);

a spring perch (10*b*), having a spring perch member (10*c*) for providing a stop for the slider spring, the spring perch (10*b*) also having protruding anchor members (10*d*);

a plurality of fasteners (12);

a cover plate (10*e*), having apertures adapted for receiving one or more of the fasteners (12) for attaching the door latch (10) to the door (14), the cover plate (10*e*) also having apertures adapted for receiving the anchor members (10*d*) of the spring perch (10*b*);

a pin (11*a*);

a control rod (11*b*) having an upper end and a lower end, the lower end coupled to the door handle of the vehicle door;

a slider block (10*f*), having an aperture adapted for holding the slider spring (10*a*) and for receiving the spring perch member (10*c*), the slider block (10*f*) also having an aperture (10*g*) adapted for receiving the pin (11*a*) coupling the slider block (10*f*) to the upper end of the control rod (11*b*), the slider block (10*f*) also having a cutout portion adapted for receiving the control rod (11*b*) and disposed so that the pin (11*a*) passes through the cutout portion, the slider block (10*f*) also having two control link apertures (10*j*), the control link apertures located on opposite sides of the slider block (10*f*), each control link aperture (10*j*) opening into the aperture adapted for holding the slider spring (10*a*);

a control link dowel pin (10*r*);

a swivel dowel pin (10*t*);

a tongue (10*k*), provided as a body formed so as to have a substantially planar strike face (10*m*) and a curved catch face (10*n*) meeting at an apex portion (10*p*) of the tongue (10*k*), and having an aperture (10*q*) proximate to the catch face (10*n*) adapted for receiving the control link dowel pin (10*r*), the tongue (10*k*) also having an aperture (10*s*) proximate the strike face (10*m*) adapted for receiving the swivel dowel pin (10*t*), the tongue (10*k*) further having a cavity (10*u*) aligned with and encompassing a portion of the aperture proximate the strike face (10*m*);

a torsion spring (10*v*) having two arms and disposed within the cavity (10*u*), the torsion spring (10*v*) also having a coiled portion pierced by the swivel dowel pin (10*t*) and oriented so as to urge a pivoting of the tongue (10*k*) about the swivel dowel pin (10*t*) in a direction away from the slider block (10*f*) by one arm pushing against the cover plate (10*e*) and the other arm pushing against a surface of the tongue (10*k*);

two slider dowel pins (10*x*);

two elongated control links (10*w*), each elongated control link having an aperture at an uppermost end and also at a lowermost end, the two control links (10*w*) disposed on opposite sides of the slider block (10*f*), each elongated control link (10*w*) coupled to the slider block (10*f*) via a respective one of the slider dowel pins (10*x*) extending from a respective one of the lowermost apertures into the proximate slider block aperture (10*j*), wherein each control link (10*w*) is also coupled to the tongue (10*k*) via the control link dowel pin (10*r*) extending out from both sides of the tongue (10*k*) into the uppermost apertures of the control links (10*w*); and two side blocks (10*y*), each side block (10*y*) having apertures (10*z*) adapted for receiving a respective one or more of the fasteners (12) for attaching the door latch (10) to the door, the side blocks (10*y*) disposed on opposite sides of the slider block (10*f*), and each side block (10*y*) having an aperture (10*z*) adapted for receiving the swivel dowel pin (10*t*) on which the tongue (10*k*) swivels relative to the two side blocks (10*y*).

* * * * *